US011287094B2

(12) United States Patent
Zheng et al.

(10) Patent No.: US 11,287,094 B2
(45) Date of Patent: Mar. 29, 2022

(54) AURORA AND NIGHT SKY LIGHT PROJECTOR

(71) Applicant: Shenzhen Skoe Technology Co., Ltd., Shenzhen (CN)

(72) Inventors: Caijian Zheng, Shenzhen (CN); Wenzhen Ouyang, Shenzhen (CN)

( * ) Notice: Subject to any disclaimer, the term of this patent is extended or adjusted under 35 U.S.C. 154(b) by 0 days.

(21) Appl. No.: 17/392,235

(22) Filed: Aug. 2, 2021

(65) Prior Publication Data

US 2021/0364142 A1 Nov. 25, 2021

(30) Foreign Application Priority Data

Jul. 12, 2021 (CN) ..... 202121577966.3

(51) Int. Cl.

| | |
|---|---|
| ***F21S 10/00*** | (2006.01) |
| ***F21V 33/00*** | (2006.01) |
| ***F21V 23/04*** | (2006.01) |
| ***F21V 3/04*** | (2018.01) |
| *F21Y 115/10* | (2016.01) |

(52) U.S. Cl.

CPC ..... *F21S 10/007* (2013.01); *F21V 3/049* (2013.01); *F21V 23/04* (2013.01); *F21V 33/0056* (2013.01); *F21Y 2115/10* (2016.08)

(58) Field of Classification Search

CPC ..... F21S 10/007; F21S 10/02; F21V 33/0056; F21V 5/02

See application file for complete search history.

(56) References Cited

U.S. PATENT DOCUMENTS

| | | | | |
|---|---|---|---|---|
| 1,351,562 | A * | 8/1920 | Foster | F21S 10/007 362/569 |
| 5,050,056 | A * | 9/1991 | Ellison | F21S 10/00 362/300 |
| 9,664,373 | B2 * | 5/2017 | Zhang | F21S 10/007 |
| 9,752,761 | B2 * | 9/2017 | Lentine | F21S 10/007 |
| 10,830,410 | B1 * | 11/2020 | Wei | F21S 10/063 |
| 11,041,596 | B1 * | 6/2021 | Zhang | F21S 10/00 |
| 11,092,301 | B2 * | 8/2021 | Zheng | F21S 10/007 |
| 11,118,745 | B2 * | 9/2021 | Zheng | F21S 10/007 |
| 11,118,753 | B1 * | 9/2021 | Zheng | F21V 3/049 |
| 2004/0175014 | A1 * | 9/2004 | Liu | H04R 1/028 381/386 |
| 2005/0111224 | A1 * | 5/2005 | Lin | F21S 10/00 362/276 |
| 2007/0097681 | A1 * | 5/2007 | Chich | F21S 10/00 362/232 |

(Continued)

*Primary Examiner* — Ismael Negron

(57) ABSTRACT

The light projector includes a housing and an upper cover which form a containing cavity; a light-emitting component, a laser lamp component, a main control board, a speaker and a cavity bracket are all arranged within the cavity. The cavity bracket is provided with a motor fixing groove and a limiting wall, the light-emitting component is arranged in the limiting wall, a motor is placed on the motor fixing groove and is fixed through a fixing lug, a refracting surface of an optical lens is formed by a plurality of curved striped prisms. An aurora sheet is rotated by the drive component, light from the light emitting lamp shining through the aurora sheet and projected by the refracting surface of the optical lens to form a dynamic aurora pattern. The laser lamp component is configured to project an illumination pattern simulating.

9 Claims, 6 Drawing Sheets

(56) References Cited

U.S. PATENT DOCUMENTS

| | | | | |
|---|---|---|---|---|
| 2015/0070660 | A1 | 3/2015 | Kadotani et al. | |
| 2019/0203913 | A1* | 7/2019 | Wu | F21S 10/00 |
| 2020/0218140 | A1 | 7/2020 | So | |
| 2021/0164628 | A1 | 6/2021 | Zheng et al. | |

* cited by examiner

AURORA AND NIGHT SKY LIGHT PROJECTOR

TECHNICAL FIELD

The present invention relates to a projection device, and in particular, to a polar light projector.

BACKGROUND

At present, commercially available projection starry lamps project patterns with the cosmic starry and the like on a ceiling or wall at home by using a projection technology, and the splendid starry can be seen by projection. However, this type of starry lamps often have the defects that the pattern is single, which cannot fully satisfy different viewing needs of users, and cannot present an aurora effect, and the device is not compact enough in structure.

SUMMARY

To overcome the defects of the prior art, the present invention provides a polar light projector, which can create a starry atmosphere with dynamic aurora.

The technical solution for solving the technical problem in the present invention is: to provide a polar light projector, including a housing and an upper cover which form a containing cavity, where the width of the housing gradually increases upwards from the bottom, the upper surface of the housing is arranged in an inclined way, the containing cavity is internally provided with a light-emitting lamp path component for projecting aurora, a laser lamp path component for emitting all-over-sky star-shaped light, a main control board, a speaker and a cavity bracket, the light-emitting lamp path component includes an optical lens, an aluminum substrate, a light source component, an aurora sheet and a drive component, two ends of the cavity bracket separately abut against an inner wall of the housing, the cavity bracket is provided with a motor fixing groove and a limiting wall, the light-emitting lamp path component is arranged in the limiting wall, the drive component includes a motor and an output shaft, the depth of the motor fixing groove is greater than the height of the motor, the motor is further provided with a fixing lug, a limiting groove is formed on the motor fixing groove, the motor is placed on the motor fixing groove and is fixed through the fixing lug, the aluminum substrate is arranged on the output shaft by sleeving, and the top of the output shaft abuts against the aurora sheet; and the optical lens passes through the upper cover and the lower end of the optical lens is pressed tightly by the upper cover to fit the limiting wall, a refracting surface of the optical lens is formed by splicing a plurality of curved striped prisms, the speaker is arranged below the cavity bracket, the laser lamp path component is arranged between the cavity bracket and the inner wall of the housing, another side of the cavity bracket is further provided with a groove, and the groove is internally provided with a vibrating diaphragm.

In one embodiment, the light source component includes an LED lamp arranged on the aluminum substrate and a condensing lens arranged above the LED lamp, the condensing lens is fixed on the aluminum substrate through a lens holder, the bottom of the lens holder is provided with a buckle, the aluminum substrate is correspondingly provided with a clamping hole, and the lens holder is buckled on the aluminum substrate.

In one embodiment, the aluminum substrate is provided with a fixing hole, and the cavity bracket is provided with a fixing column for fixing the aluminum substrate.

In one embodiment, elastic deformation gaps are formed on two sides of the lens holder corresponding to the position of the buckle, and the lens holder is made of an elastic material.

In one embodiment, a long strip hole for the LED lamp to pass through is formed at the bottom of the lens holder, the upper end of the lens holder is provided with an annular concave step, a limiting boss is arranged corresponding to the upper end of the long strip hole, the condensing lens is provided with a flange matched with the annular concave step, and a limiting gap is arranged corresponding to the position of the limiting boss.

In one embodiment, the bottom of the housing is provided with four supporting feet.

In one embodiment, the laser light path component includes a laser, a grating sheet and a first light outlet hole provided on the upper cover, a light-receiving surface of the grating sheet is arranged toward a light-emitting surface of the laser, a light-emitting surface of the grating sheet is arranged toward the first light outlet hole, and a side wall of the laser is provided with a radiator for heat dissipation of the laser.

In one embodiment, the main control board is provided with an audio component for making white noise, the audio component is electrically connected to the main control board, the upper cover is provided with a sound reception hole, and a sound outlet hole is formed on the housing corresponding to the position of the speaker.

In one embodiment, the optical lens is semi-spherical, an outer spherical surface of the optical lens is a smooth surface without texture, and a plurality of curved striped prisms are distributed on an inner spherical surface of the optical lens.

In one embodiment, the polar light projector further includes a button component, the button component is electrically connected to the main control board, the main control board is further provided with a communication module and an audio module, and the communication module includes a Bluetooth module and a Wi-Fi module.

The present invention has the advantageous effects that, according to the polar light projector provided by the present invention, the refracting surface of the optical lens is formed by splicing the plurality of curved striped prisms, and makes a light path of the light-emitting lamp path component form a wonderful aurora pattern that is projected to the outside, and a drive component is arranged to drive an aurora sheet to rotate, thereby presenting a dynamic aurora-like pattern, and making an aurora atmosphere more irregular; at the same time, the structure of the cavity bracket is utilized to separate the parts, so that the structure is compact and attractive; and the vibrating diaphragm can reduce interference to the speaker.

BRIEF DESCRIPTION OF DRAWINGS

The present invention will be further described with reference to accompanying drawings and embodiments, in which.

Figure 1:
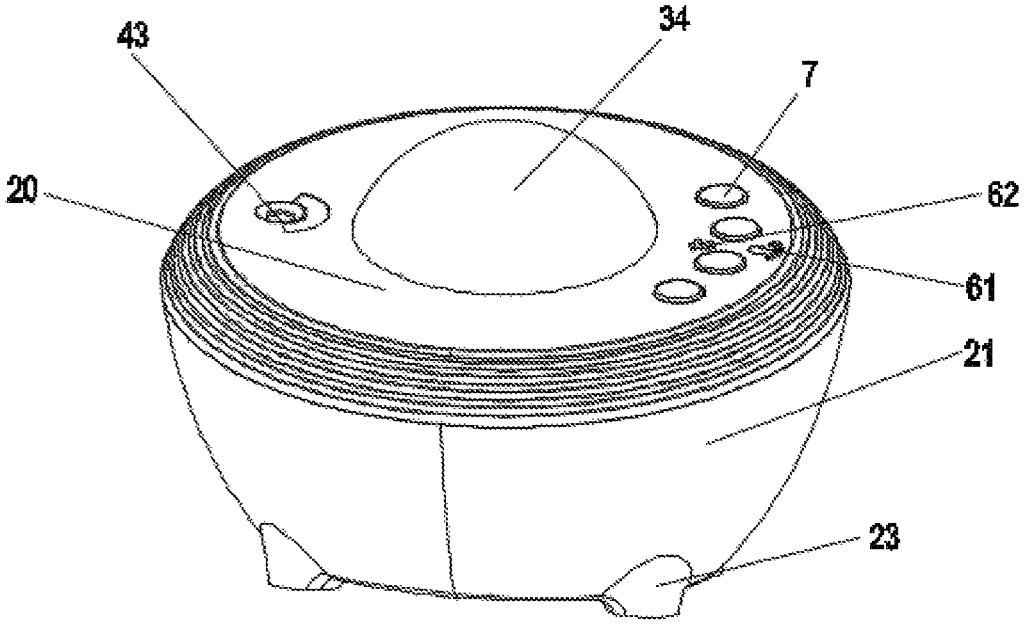
FIG. 1 is a schematic overall structural diagram according to the present invention.

Cavity bracket 1; motor fixing groove 11; limiting groove 111; limiting wall 12; fixing column 13; groove 14; upper cover 20; second blocking edge 201; housing 21; containing cavity 22; supporting foot 23; sound outlet hole 24; aluminum substrate 31; fixing hole 311; clamping hole 312; aurora sheet 32; LED lamp 331; condensing lens 332; flange 3321; limiting gap 3322; lens holder 333; long strip hole 3331; annular concave step 3332; limiting boss 3333; buckle 3334; elastic deformation gap 3335; optical lens 34; first blocking edge 341; curved striped prism 342; motor 351; output shaft 352; fixing lug 353; laser 41; grating sheet 42; first light outlet 43; radiator 44; speaker 51; vibrating diaphragm 52; main control board 6; wireless remote control receiving head 61; sound reception hole 62; button component 7.

DESCRIPTION OF EMBODIMENTS

To make the technical problems to be solved, technical solutions and advantageous effects of the present invention clearer, the present invention is further described in detail with reference to accompanying drawings and embodiments below. It should be understood that the specific embodiments described herein are merely used to explain the present invention, and are not used to limit the present invention.

Figure 2:
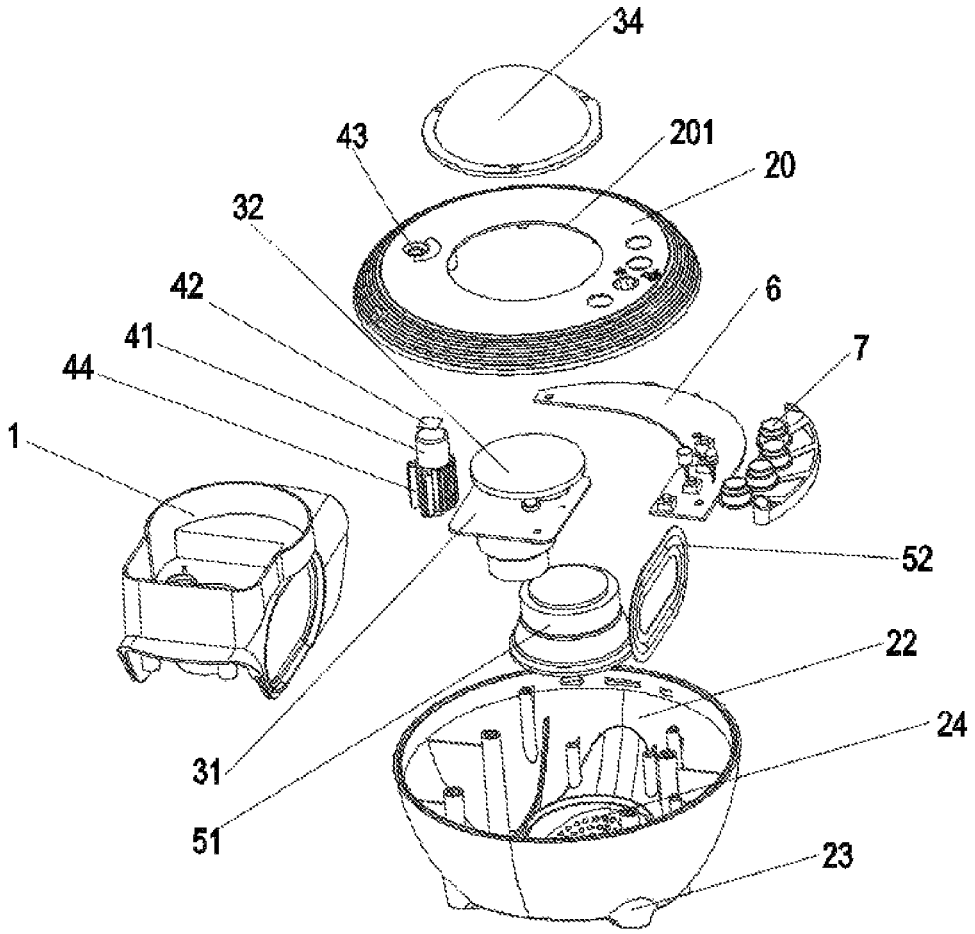
FIG. 2 is a sectional view of a light-emitting lamp path component according to the present invention.
Figure 3:
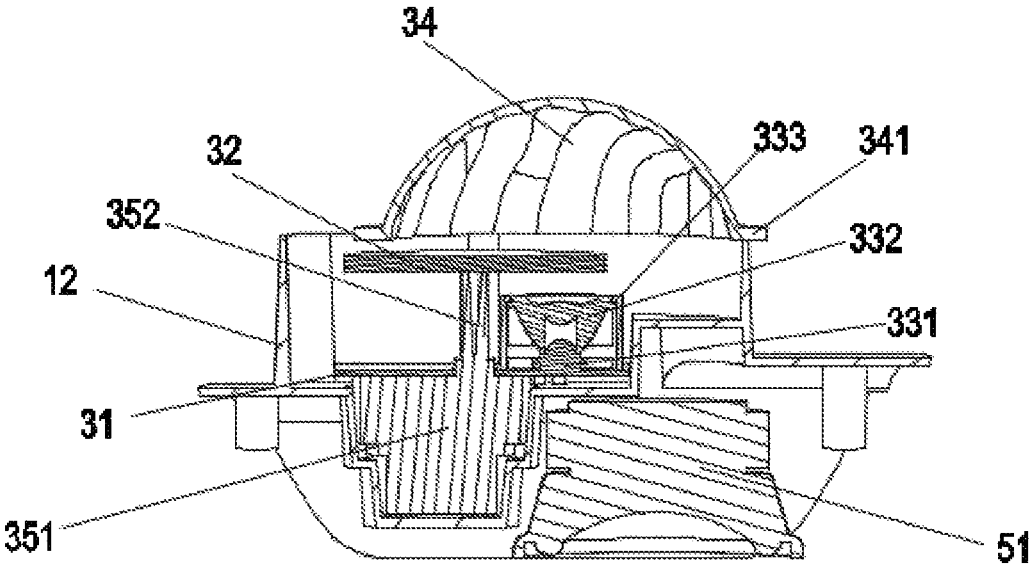
FIG. 3 is a schematic structural diagram of a light source component according to the present invention.
Figure 4:
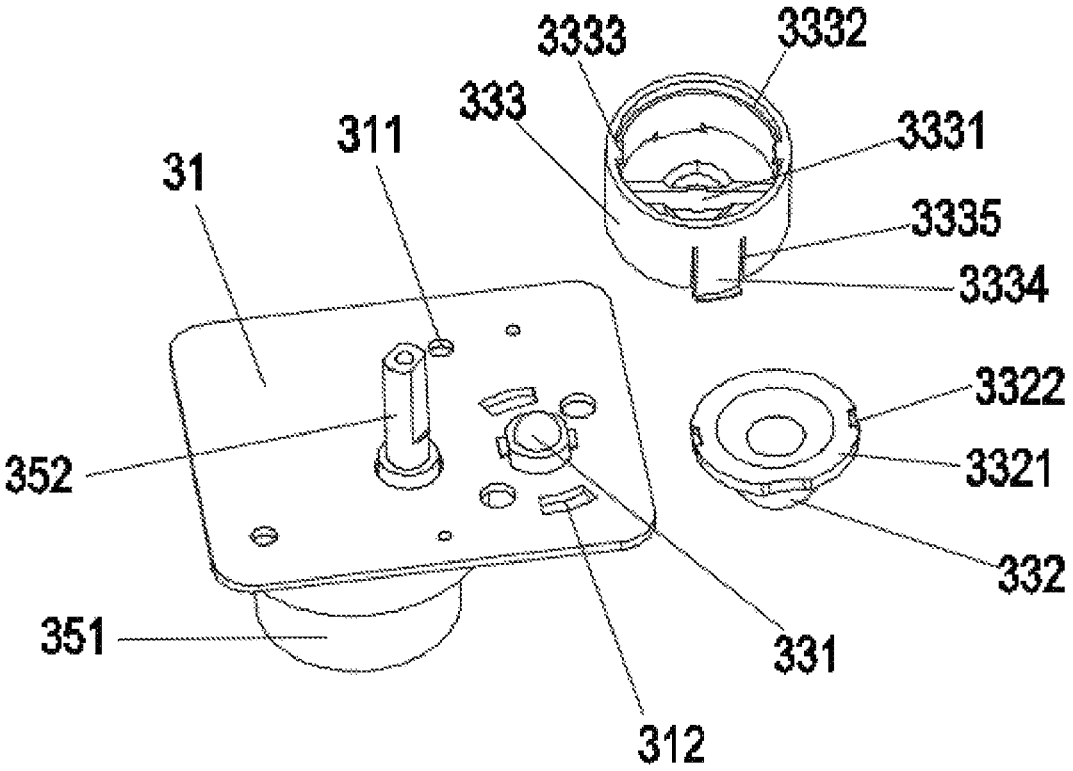
FIG. 4 is a schematic structural diagram of a light source component according to the present invention.
Figure 5:
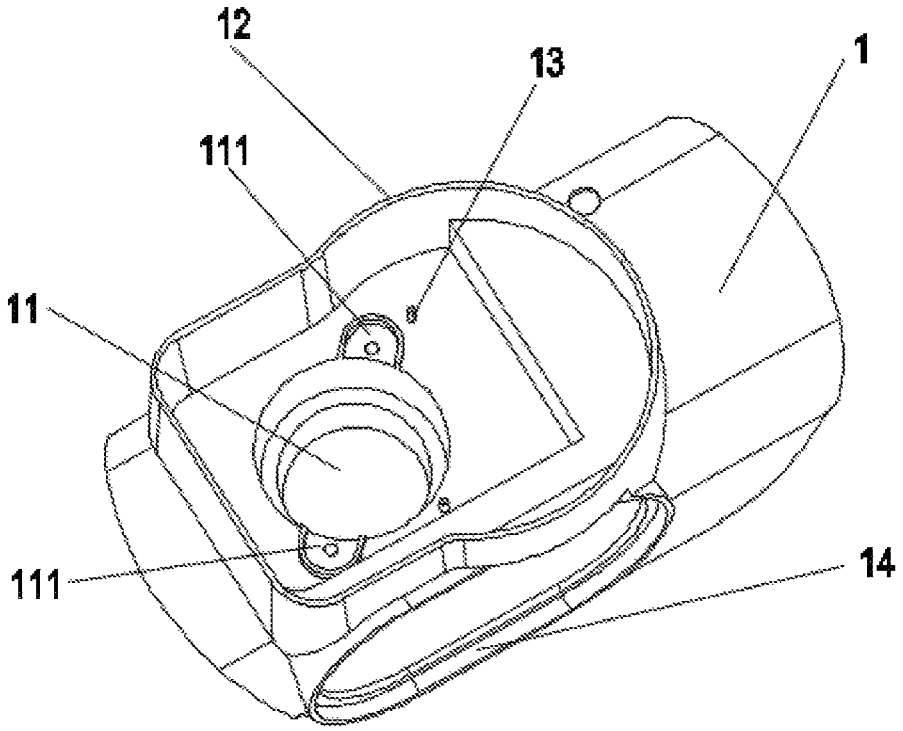
FIG. 5 is a schematic structural diagram of a cavity bracket according to the present invention.
Figure 6:
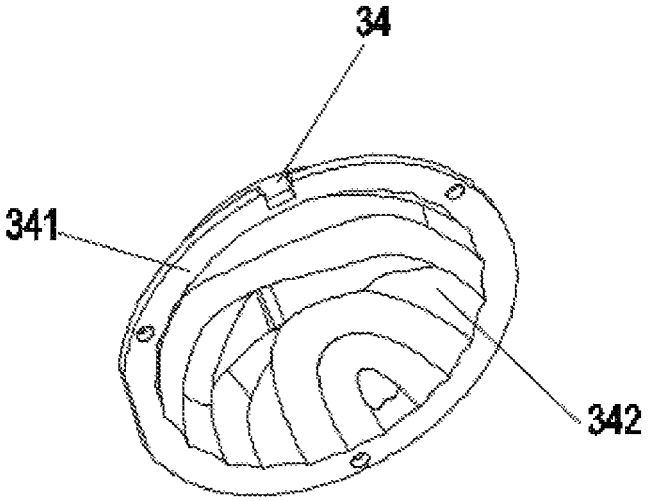
FIG. 6 is a schematic structural diagram of an optical lens according to the present invention.
Figure 7:
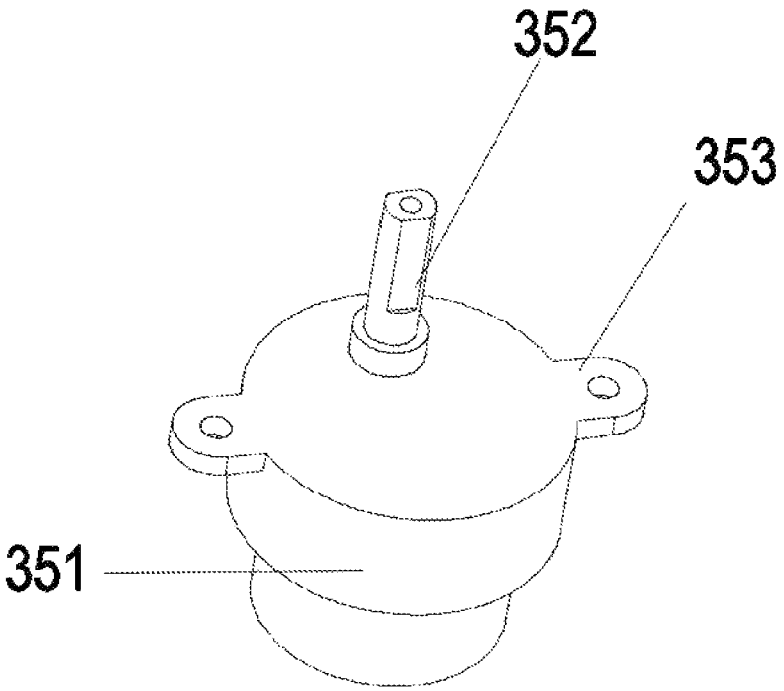
FIG. 7 is a schematic structural diagram of a motor component according to the present invention.

Referring to FIG. 1 to FIG. 7, a polar light projector is provided, including an upper cover 20 and a housing 21, where the width of the housing 21 gradually increases upwards from the bottom, the upper surface of the housing 21 is arranged in an inclined way, and the housing 21 is wide at the top and narrow at the bottom, and forms a cornucopia-shaped containing cavity 22 with the upper cover 20. The containing cavity 22 is internally provided with a light-emitting lamp path component, a laser lamp path component, a cavity bracket 1, a speaker 51 and a main control board 6, where the light-emitting lamp path component is used for emitting light with an aurora pattern, the light-emitting lamp path component is rotatably arranged, and the laser lamp path component is used for emitting all-over-sky star-shaped light.

Specifically, two ends of the cavity bracket 1 separately abut against an inner wall of the housing 21, the cavity bracket 1 is provided with a motor fixing groove 11 and a limiting wall 12, the light-emitting lamp path component includes an optical lens 34, an aluminum substrate 31, a light source component, an aurora sheet 32 and a drive component, the light-emitting lamp path component is arranged in the limiting wall 12, the drive component includes a motor 351 and an output shaft 352, the depth of the motor fixing groove 11 is greater than the height of the motor 351, the motor 351 is further provided with a fixing lug, a limiting groove for placing the fixing lug is formed on the motor fixing groove 11, and the motor 351 is placed on the motor fixing groove 11 and is fixed through the fixing lug, where the depth of the motor fixing groove 11 is greater than the height of the motor 351, so that the motor 351 can have a heat dissipation space, to prevent overheating from affecting the life of the device.

The aluminum substrate 31 is arranged on the output shaft 352 by sleeving, and the top of the output shaft 352 abuts against the aurora sheet 32, to drive the aurora sheet 32 to rotate and further form a dynamic aurora pattern.

In one embodiment, the aluminum substrate 31 is provided with a fixing hole 311, the cavity bracket is provided with a fixing column 13 for fixing, and through the cooperation of the fixing column 13 and the fixing hole 311, the aluminum substrate 31 is fixed on the cavity bracket 1, ensuring the stability of the aluminum substrate 31.

The light source component includes an LED lamp 331 arranged on the aluminum substrate 31 and a condensing lens 332 arranged above the LED lamp 331, the light source component is arranged below the aurora sheet 32, and the condensing lens 332 is fixed on the aluminum substrate 31 through a lens holder 333. Specifically, a long strip hole 3331 for the LED lamp 331 to pass through is formed at the bottom of the lens holder 333, the upper end of the lens holder 333 is provided with an annular concave step 3332, a limiting boss 3333 is provided corresponding to the upper end of the long strip hole 3331, the condensing lens 332 is provided with a flange 3321 matched with the annular concave step 3332, and a limiting gap 3322 is provided corresponding to the position of the limiting boss 3333. The condensing lens 332 is placed on the annular concave step 3332 and positioning and fixing are performed by utilizing the limiting gap 3322 and the limiting boss 3333, so that the condensing lens 332 can be stably placed above the LED lamp 331, so as to perform condensation on the LED lamp 331.

In this embodiment, one LED lamp 331 is provided, the LED lamp 331 emits light, and the light may be monochromatic or formed by multicolor lamp beads. In other embodiments, multiple groups of light source components may be provided.

In one embodiment, the lens holder 333 and the aluminum substrate 31 are in clamping connection. Specifically, the bottom of the lens holder 333 is provided with a buckle 3334, the aluminum substrate 31 is correspondingly provided with a clamping hole 312, and the lens holder 333 is buckled on the aluminum substrate 31. Furthermore, the lens holder 333 is made of an elastic material, elastic deformation gaps 3335 are formed on two sides of the lens holder 333 corresponding to the position of the buckle 3334 to ensure that the lens holder 333 and the aluminum substrate 31 can perform buckling release by utilizing elasticity, and when in buckling and buckling release, the lens holder 333 and the aluminum substrate 31 do not damage the lens holder 333 under the action of elastic force.

The optical lens 34 passes through the upper cover 20 and the lower end thereof is pressed tightly by the upper cover 20 to fit the upper side of the limiting wall 12. Specifically, the optical lens 34 is semi-spherical, the lower end of the optical lens 34 is provided with a first blocking edge 341 in an extending way, the upper cover 20 has a second blocking edge 201, and when the upper cover 20 is closed on the housing 21, the second blocking edge 201 is pressed tightly against the first blocking edge 341 to the limiting wall 12. Through the above-mentioned structure, the optical lens 342 is tightly mounted above the light-emitting lamp path component, the structure is simple and compact, and the connection is tight.

In the present invention, the optical lens 34 is provided with a refracting surface, the refracting surface is formed by splicing a plurality of curved striped prisms 342, and the curved striped prisms 342 reflect and fold light rays, and have a magnifying function.

Furthermore, an outer spherical surface of the optical lens 34 is a smooth surface without texture, the plurality of curved striped prisms 342 are distributed on an inner spherical surface of the optical lens 34, and mirror surfaces of the curved striped prisms 342 are distributed along the inner spherical surface of the optical lens 34 from center to edge, which can ensure that the exterior of the projection lamp is smooth. A light source of the LED lamp 331 is firstly gathered by utilizing the condensing lens 332, afterwards passes through the rotating aurora sheet 32 to form a dynamic aurora pattern, then passes through the optical lens 34 to be reflected and refracted, and is projected to form a special and wonderful aurora pattern effect with a large area, thereby providing people good visual enjoyment.

The laser light path component is arranged in a space between the cavity bracket 1 and the inner wall of the housing 21, and includes a laser 41 and a grating sheet 42, a first light outlet 43 is formed on the upper cover 20, a light receiving surface of the grating sheet 42 is arranged toward a light-emitting surface of the laser 41, and a light-emitting surface of the grating sheet 42 is arranged toward the first light outlet 43; and a side wall of the laser 41 is provided with a radiator 44, and the radiator 44 is used for the laser 41 to dissipate heat. The laser light path component is utilized to form an all-over-sky star-shaped pattern, which, together with an aurora pattern, forms a wonderful starry sky atmosphere with the aurora pattern.

The light-emitting lamp path component and the laser light path component are both electrically connected to the main control board 6, so that a user can control the brightness of light emitted by the light-emitting lamp path component through the main control board 6, and can also control the speed of the drive component to control the rotation speed of the aurora pattern at the same time, thereby being adapted to different needs of the user.

In the present embodiment, the main control board 6 is in a semi-annular shape, the main control board 6 is arranged above the cavity bracket 1, the polar light projector further includes a speaker 51, the speaker 51 is electrically connected to the main control board 6, the speaker 51 is arranged at one end, away from the motor fixing groove 11, of the lower part of the cavity bracket 1, another side of the cavity bracket 1 is further provided with a groove 14, and the groove 14 is internally provided with a vibrating diaphragm 52 for reducing the influence of interference to the speaker 51, thereby ensuring the audio play quality of the polar light projector.

The main control board 6 is provided with a communication module and an audio module, the audio component can play burned white noise, the audio component is electrically connected to the main control board 6, the upper cover 20 is provided with a sound reception hole 62 and a wireless remote control receiving head 61, and the housing 21 is provided with a sound outlet hole 24 corresponding to the position of the speaker 51. The sound reception hole 62 is used to receive audio, and the wireless remote control receiving head 61 is used to receive a wireless signal sent by a mobile terminal. A side wall of the housing 21 is further provided with a charging port for charging and powering the polar light projector.

The communication module includes a Bluetooth module and a Wi-Fi module, the communication module can realize communication connection between a polar light projector and an external device (such as a smart mobile terminal) and the like, so as to realize control on a product through the external device and realize the intelligentization, which can be specifically represented as remotely controlling the audio component to play through Bluetooth or Wi-Fi connection, controlling light color, brightness and light effects, and performing timing switcher functions.

The polar light projector further includes a button component 7, the button component 7 is electrically connected to the main control board 6, the button component 7 passes through the upper cover 20, and the button component 7 may include a volume adjustment button and Play/pause button as well as a Bluetooth/white noise switching button and the like. The main control board 6 is further connected to a brightness adjustment knob, one end of the brightness adjustment knob is electrically connected to the main control board 6, the other end thereof passes through a side wall of the housing 21, and the brightness of the polar light projector can be adjusted through the brightness adjustment knob.

In one embodiment, the bottom of the housing 21 is provided with supporting feet 23 in an extending way, and four supporting feet 23 are provided to ensure that the polar light projector can be placed stably. Furthermore, non-slip pads can be added on the supporting feet 23.

As mentioned above, one or more implementation manners are provided in combination with specific contents, and it is not deemed that the specific implementation of the present invention is merely limited to these descriptions. Any method, structure and the like similar to or identical to those of the present invention, or several technical deductions or replacements made under the premise of the present invention conception, should be regarded as falling within the protection scope of the present invention.

What is claimed is:

1. A polar light projector, comprising:

a housing with width which gradually increases from the bottom upwards, and having an inner wall defining a cavity;

an upper cover closing the cavity;

a light-emitting lamp component having an aluminum substrate, a light source mounted on the aluminum substrate;

an optical lens coupled to upper cover, the optical lens having a refracting surface with a plurality of curved striped prisms;

a drive component having a motor with an output shaft extending through the aluminum substrate, and an aurora sheet coupled to the output shaft to be rotated by the motor, the motor further including a fixing lug;

a laser lamp component for emitting a light pattern simulating stars in the night sky, a main control board, a speaker; and a cavity bracket having two ends separately abutting the inner wall of the housing, the cavity bracket provided with a motor fixing groove with a depth greater than the height of the motor, a limiting groove formed on the fixing groove, and a limiting wall, and another groove; and a vibrating diaphragm provided in the another groove, wherein the motor is arranged on the motor fixing groove and fixed through the fixing lug, a lower end of the optical lens is pressed tightly by the upper cover to fit the limiting wall, the speaker is arranged below the cavity bracket, the laser lamp component is arranged between the cavity bracket and the inner wall of the housing, and the vibrating diaphragm is positioned opposite the laser lamp component with respect to the cavity bracket.

2. The aurora and night sky light projector according to claim 1, wherein the aluminum substrate includes a clamping hole, and the light source comprises an LED lamp arranged on the aluminum substrate, a condensing lens arranged above the LED lamp, and a lens holder fixing the condensing lens to the aluminum substrate, the lens holder provided with a buckle at a bottom end, the buckle coupled to the clamping hole for securing the lens holder on the aluminum substrate.

3. The aurora and night sky light projector according to claim 2, wherein the aluminum substrate comprises a fixing hole, and the cavity bracket comprises a fixing column for fixing the aluminum substrate.

4. The aurora and night sky light projector according to claim 2, wherein the lens holder is made of an elastic material, and elastic deformation gaps are formed on two sides of the lens holder corresponding to the position of the buckle.

5. The aurora and night sky light projector according to claim 4, wherein a bottom of the lens holder includes a long strip hole for the LED lamp to pass through, an annular concave step provided at an upper end of the lens holder, a limiting boss is provided to correspond to an upper end of the long strip hole, a flange is provided in the condensing lens to match with the annular concave step, and a limiting gap is arranged corresponding to the position of the limiting boss.

6. The aurora and night sky light projector according to claim 5, further comprising four supporting feet provided at the bottom of the housing.

7. The aurora and night sky light projector according to claim 6, the laser light component comprises a laser, a grating sheet and a radiator provided on a sidewall of the laser for dissipating heat from the laser, wherein the upper cover is provided with a first light outlet hole and a light-emitting surface of the grating sheet is arranged toward the first light outlet hole.

8. The aurora and night sky light projector according to claim 7, wherein the upper cover is provided with a sound reception hole, and the housing includes a sound outlet hole corresponding to the position of the speaker.

9. The aurora and night sky light projector according to claim 8, wherein the optical lens has a smooth semi-spherical outer surface, and the plurality of curved striped prisms are formed on an inner spherical surface of the optical lens.

* * * * *